US012492570B2

(12) United States Patent
Tassinari

(10) Patent No.: US 12,492,570 B2
(45) Date of Patent: Dec. 9, 2025

(54) MACHINE FOR THE INTRODUCTION OF POLES INTO THE GROUND, PARTICULARLY FOR THE REINFORCEMENT OF SAFETY BARRIERS

(71) Applicant: ORTECO—S.R.L., Anzola dell'Emilia (IT)

(72) Inventor: Sergio Tassinari, Anzola dell'Emilia (IT)

(73) Assignee: ORTECO—S.R.L., Anzola dell'Emilia (IT)

( * ) Notice: Subject to any disclaimer, the term of this patent is extended or adjusted under 35 U.S.C. 154(b) by 27 days.

(21) Appl. No.: 17/761,675

(22) PCT Filed: Sep. 15, 2020

(86) PCT No.: PCT/IB2020/058545

§ 371 (c)(1),
(2) Date: Mar. 18, 2022

(87) PCT Pub. No.: WO2021/053498

PCT Pub. Date: Mar. 25, 2021

(65) Prior Publication Data

US 2022/0396965 A1 Dec. 15, 2022

(30) Foreign Application Priority Data

Sep. 18, 2019 (IT) ..... 102019000016658

(51) Int. Cl.
*E02D 7/10* (2006.01)
*E01F 15/04* (2006.01)
(Continued)

(52) U.S. Cl.
CPC ..... *E04H 12/347* (2013.01); *E01F 15/0484* (2013.01); *E04H 17/263* (2013.01)

(58) Field of Classification Search
CPC .. E04H 12/347; E04H 17/263; E01F 15/0484; E21B 7/028; E02D 7/10
See application file for complete search history.

(56) References Cited

U.S. PATENT DOCUMENTS 177,587 A * 5/1876 Tally ..... E21B 7/26 175/84
281,848 A * 7/1883 Dixon et al. ..... E21B 7/02 173/124

(Continued)

FOREIGN PATENT DOCUMENTS

CN 110 040 057 A 7/2019
GB 2 441 071 A 2/2008

(Continued)

*Primary Examiner* — Edwin J Toledo-Duran
(74) *Attorney, Agent, or Firm* — ASLAN LAW, P.C.

(57) ABSTRACT

A machine for the introduction of poles into the ground, particularly for the reinforcement of safety barriers. The machine including one movement assembly for the movement of the machine at the point where one safety barrier to be reinforced is located; one insertion assembly associated movable with the movement assembly and adapted to introduce at least partly into the ground one reinforcement pole at the point where the safety barrier is located; positioning device/component/unit (or the like) associated with the movement assembly and adapted to position the insertion assembly between: one home position, wherein it approaches the movement assembly; one operating position, wherein it is located beyond the safety barrier; and one insertion position, wherein it is tilted by an angle of insertion for the introduction of the reinforcement pole at the point where the safety barrier is located.

17 Claims, 8 Drawing Sheets

(51) Int. Cl.
*E04H 12/34* (2006.01)
*E04H 17/26* (2006.01)

(56) References Cited

U.S. PATENT DOCUMENTS 1,230,632 A * 6/1917 Upchurch et al. ..... E21B 7/02 173/87
2,244,899 A * 6/1941 Smith ..... E04H 17/263 254/387
2,660,035 A * 11/1953 Zeiser ..... E21B 7/021 173/44
2,844,006 A * 7/1958 Lutz ..... E04H 17/263 173/27
2,950,603 A * 8/1960 Macek ..... E02D 7/08 173/87
3,026,949 A * 3/1962 Eldridge ..... E04H 17/263 173/112
3,058,285 A * 10/1962 Jolls ..... A01D 34/866 56/10.4
3,446,296 A * 5/1969 Anderson ..... E04H 17/263 173/45
3,548,604 A * 12/1970 Campbell ..... E02D 7/16 173/28
3,602,316 A * 8/1971 McNicholas ..... E04H 17/263 173/28
3,703,934 A * 11/1972 Cartner ..... E04H 17/263 173/193
4,050,526 A * 9/1977 Deike ..... E21B 7/028 173/147
4,139,067 A * 2/1979 Craig ..... A01G 17/16 173/27
4,290,712 A * 9/1981 Hayes ..... E01F 9/608 52/297
4,311,300 A * 1/1982 Buerger ..... E04H 17/263 256/19
4,542,880 A * 9/1985 Bishop ..... E02D 7/20 254/29 R
4,932,634 A * 6/1990 Sura ..... E01F 7/02 256/48
5,012,873 A * 5/1991 Kennedy ..... E01F 9/619 173/53
5,355,576 A * 10/1994 Miller ..... E01F 15/0484 29/469
6,105,683 A * 8/2000 Thiessen ..... E04H 17/263 173/147
2010/0230652 A1* 9/2010 Calton ..... E01F 15/0484 256/65.1
2014/0212214 A1* 7/2014 Sloan ..... F16G 11/04 404/6
2016/0305085 A1* 10/2016 Ranew, Jr. ..... E02B 3/04
2018/0224277 A1* 8/2018 Latova ..... G01C 15/008
2018/0291576 A1* 10/2018 Yoo ..... E01F 15/0484
2019/0017285 A1* 1/2019 Kain ..... E04H 17/08

FOREIGN PATENT DOCUMENTS

GB 2 493 115 A 1/2013
WO WO 2019/008525 A1 1/2019

* cited by examiner

MACHINE FOR THE INTRODUCTION OF POLES INTO THE GROUND, PARTICULARLY FOR THE REINFORCEMENT OF SAFETY BARRIERS

CROSS-REFERENCE TO RELATED APPLICATIONS

This application claims priority to IT patent application No. 102019000016658 filed on Sep. 18, 2019, and this application claims priority to and is a 371 of international PCT Application No. PCT/IB2020/058545 filed on Sep. 15, 2020, the entire contents of which are hereby incorporated by reference.

TECHNICAL FIELD

The present invention relates to a machine for the introduction of poles into the ground, particularly for the reinforcement of safety barriers.

BACKGROUND ART

The pole drivers of known type can be usually associated with appropriate dedicated vehicles or with vehicles of conventional type such as, e.g., tractors, forklifts, excavators that allow their movement on the ground on which they are to be operated.

Pole drivers are used in various sectors of activity such as, e.g., in agriculture for crop supporting structures, in the energy sector for the installation of photovoltaic systems, in the road safety sector for the installation of safety barriers, and many others.

In the field of road safety, moreover, there are well known pole drivers for the insertion of reinforcement poles at the point where the already existing safety barriers are located, in order to reinforce them.

It is well known that road barriers and the ground in which they are installed must be subject to strict structural requirements in order to ensure optimal strength to any impact from vehicles in transit.

The safety barriers, therefore, need periodic maintenance interventions as a result of geological changes in the soil and/or to comply with the requirements imposed by current regulations.

The maintenance of safety barriers involves a reinforcement operation carried out by inserting a reinforcement pole into the ground, on the side of the barrier sustaining pole, inclined by about 135° with respect to the road surface; therefore, this operation is generally carried out beyond the safety barrier, with respect to the practicable area.

One or more operators usually provide for the positioning of the reinforcement pole while an additional operator operates the machine.

It is easy to understand that the above mentioned operation may require very long execution times.

In addition, the stretch beyond the barrier is not always practicable or, in other cases, it is difficult to access.

The operation can therefore also be extremely dangerous for the operators, who risk being hit by the machine or by the pole itself.

Still, in certain situations, the intervention of an operator is not possible. This is the case, e.g., for road stretches running along watercourses or lying on overhanging mountain stretches.

It can be understood, therefore, that there is a special need to improve the pole drivers of known type for the reinforcement of the safety barriers.

DESCRIPTION OF THE INVENTION

The main aim of the present invention is to devise a machine for the introduction of poles into the ground, particularly for the reinforcement of safety barriers, which allows for the quick and safe introduction of reinforcement poles for safety barriers, thus reducing the use of manpower.

Another object of the present invention is to devise a machine for the introduction of poles into the ground, particularly for the reinforcement of safety barriers, which allows overcoming the above mentioned drawbacks of the prior art in a simple, rational, easy, effective to use and low cost solution.

The above mentioned objects are achieved by the present machine for the introduction of poles into the ground, particularly for the reinforcement of safety barriers, having the characteristics of claim 1.

BRIEF DESCRIPTION OF THE DRAWINGS

Other characteristics and advantages of the present invention will be more evident from the description of a preferred, but not exclusive, embodiment of a machine for the introduction of poles into the ground, particularly for the reinforcement of safety barriers, illustrated by way of an indicative, yet non-limiting example, in the attached tables of drawings in which.

EMBODIMENTS OF THE INVENTION

Figure 1:
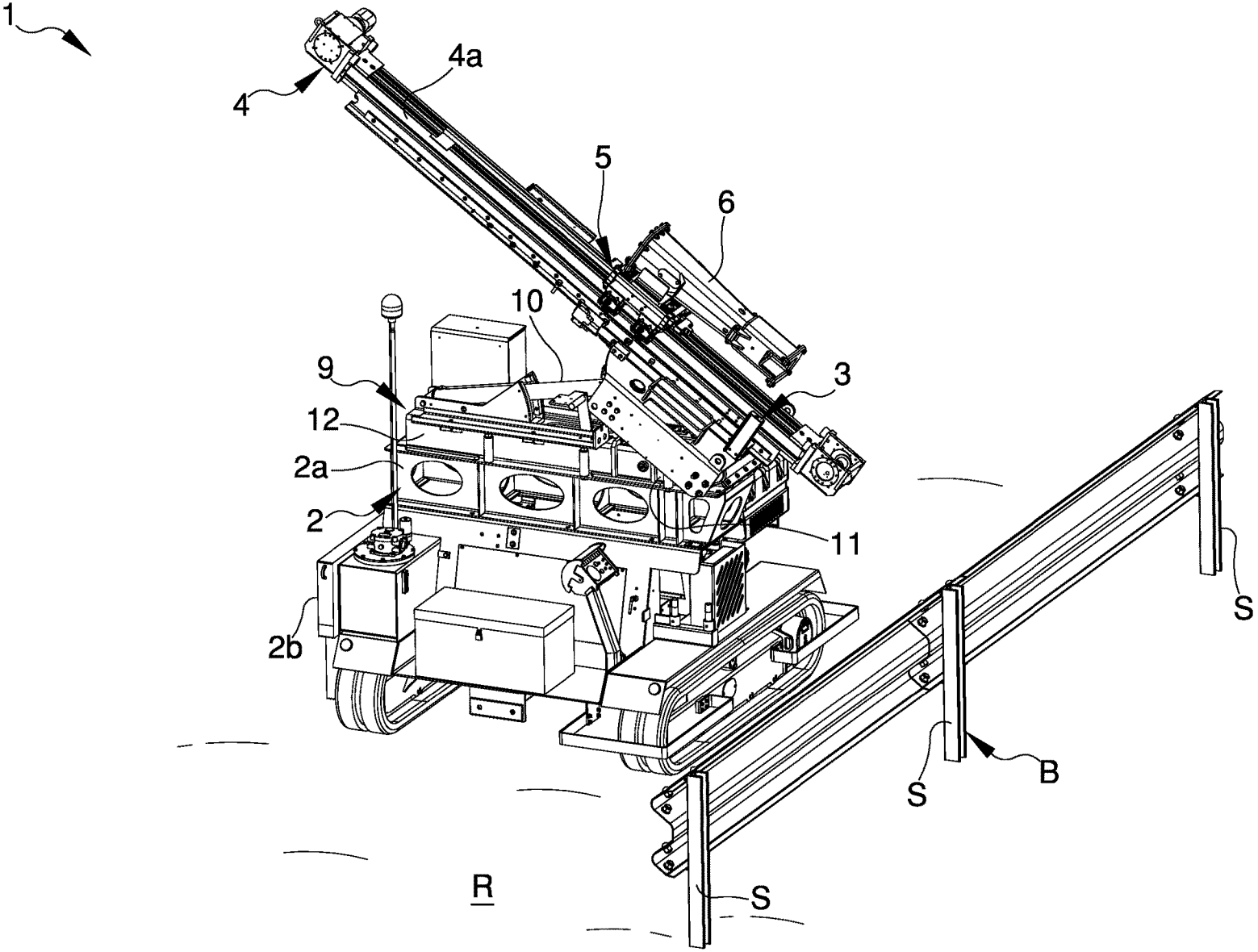
FIG. 1 is an axonometric view of an embodiment of a machine for the introduction of poles into the ground, particularly for the reinforcement of safety barriers, in a first position of use, according to the invention.

With particular reference to these figures, reference numeral 1 globally indicates a machine for the introduction of poles into the ground, particularly for the reinforcement of safety barriers.

The machine 1 according to the invention comprises:

- at least one movement assembly 2 for the movement of the machine 1 on a road surface R at the point where at least one safety barrier B to be reinforced is located;
- at least one insertion assembly 3 associated movable with the movement assembly 2 and adapted to introduce at least partly into the ground at least one reinforcement pole P at the point where the base of the safety barrier B is located.

The movement assembly 2 allows the displacement of the machine 1 on the road surface R to allow the correct positioning of the machine 1 in the proximity of the safety barrier B.

Specifically, the safety barrier B to be reinforced is composed of a series of sustaining poles S inserted in the ground, laterally to the road surface R and of a longitudinal band connecting the sustaining poles S to each other and extending substantially parallel to the road surface R.

In order to improve the support given by the ground to the safety barrier B, the reinforcement pole P is inserted into the ground laterally to the sustaining pole S of the safety barrier B and with an appropriate inclination in order to position itself at least partly below the road surface R.

More in detail, the reinforcement pole P is of the type of a metal rod between 1.0 m and 2.0 m long and is provided with at least one end suitably shaped to be inserted into the ground.

The movement assembly 2 comprises a supporting frame 2*a* mounted on wheels or tracks.

The supporting frame 2*a* is made so that the movement assembly 2 can reach a height equal to or higher than the safety barrier B, so that the insertion assembly 3 may correctly position itself beyond the safety barrier B for the insertion of the reinforcement pole P.

The movement assembly 2 is also provided with a counterweight 2*b* adapted to give a high stability and adherence to the ground to the machine 1.

The insertion assembly 3 usefully comprises at least one operating frame 4 associated movable with the movement assembly 2 and at least one insertion device 5 associated sliding with the operating frame 4.

In particular, the operating frame 4 comprises a guidance unit 4*a* on which the insertion device 5 is mounted sliding to move close to and away from the ground.

The insertion device 5 is provided with gripping means of the reinforcement pole P.

The gripping means are adapted to hold the reinforcement pole P after it has been placed in the insertion device 5 and to sustain it during the insertion thereof into the ground.

Advantageously, the insertion device 5 comprises hammering means 6 adapted to drive the reinforcement pole P at least partly into the ground.

The hammering means 6 comprise at least one hammer element and are adapted to exert pressure on the reinforcement pole P and/or hammer it into the ground.

Alternatively or in combination, the insertion device 5 comprises screwing means 7 adapted to rotate the reinforcement pole P by screwing it into the ground.

The screwing means 7 comprise a rotor element adapted to set the reinforcement pole P in rotation on itself to screw it into the ground.

The reinforcement pole P is suitably provided with a drill bit adapted to facilitate the screwing of the reinforcement pole itself into the ground.

The insertion assembly 3 is also provided with sliding means of the insertion device 5 on the operating frame 4 adapted to displace the insertion device 5 between a spacing apart position, wherein it is moved away from the road surface R, and at least one approach position, wherein it inserts the reinforcement pole P at least partly into the ground.

More in detail, the action of the sliding means combined with the hammering means 6 and/or the screwing means 7 allows inserting the reinforcement pole P at the point where the safety barrier B is located in an easy way.

Advantageously, the machine 1 comprises positioning means 9, 10 of the insertion assembly 3 associated with the movement assembly 2.

The positioning means 9, 10 are adapted to move the insertion assembly 3 to allow the insertion of the reinforcement pole P beyond the safety barrier B.

More in detail, the positioning means 9, 10 are placed between the supporting frame 2*a* and the operating frame 4 and are adapted to position the insertion assembly 3 between:

- at least one home position, wherein it approaches the movement assembly 2 to allow the transit of the machine 1;
- at least one operating position, wherein the insertion assembly 3 is located beyond the safety barrier B; and
- at least one insertion position, wherein the insertion assembly 3 is tilted by an angle of insertion $\alpha$ for the introduction of the reinforcement pole P at the point where the base of the safety barrier B is located.

Substantially, in the operating position, the machine 1 is placed adjacent to the safety barrier B and is able to pass over the road surface R so as to position the insertion assembly 3 laterally to the sustaining pole S.

In the operating position, advantageously, the insertion assembly 3 is positioned substantially orthogonal to the road surface R, in order to allow an easy positioning of the reinforcement pole P in the gripping means of the insertion device 5.

In the insertion position, on the other hand, the machine 1 is stationary to allow the insertion of the reinforcement pole P according to the angle of insertion $\alpha$.

In the ambit of the present treatise, the word "angle of insertion" means the inclination that the insertion assembly 3 has to reach with respect to the road surface R starting from the home position in order to ensure a correct introduction of the reinforcement pole P into the ground.

Appropriately, the angle of insertion $\alpha$ ranges from 130° to 150°, preferably the angle of insertion is 135°.

Advantageously, the positioning means 9, 10 comprise horizontal translation means 9, to position the insertion assembly 3 between the home position and the operating position, and rotation means 10, to position the insertion assembly 3 between the operating position and the insertion position.

The horizontal translation means 9 comprise at least one movable supporting element 11 of the insertion assembly 3 associated translatable with at least one guide element 12 mounted on the movement assembly 2.

Specifically, the guide element 12 is associated with the supporting frame 2*a* and extends along a direction D substantially transverse to the road surface R.

The movable supporting element 11 is associated with the operating frame 4 and by translating on the guide element 12 along the direction D, it allows positioning the insertion assembly 3 beyond the safety barrier B.

Conveniently, the movable supporting element 11 is of the type of a telescopic boom.

The special solution of providing a telescopic boom allows the insertion assembly 3 to be easily positioned beyond the safety barrier B and, at the same time, to give the machine 1 small size.

The horizontal translation means 9 comprise at least one actuating element 13 adapted to move the movable supporting element 11 on the movement assembly 2, between the home position and the operating position.

The actuating element 13 is of the type of a piston cylinder.

The rotation means 10 are associated with the movable supporting element 11 and are adapted to rotate the insertion assembly 3 around an axis of rotation A substantially parallel to the road surface R to position the insertion assembly itself in the insertion position.

More in detail, the movable supporting element 11 is hinged to the operating frame 4 around the axis of rotation A.

The rotation means 10 are of the type of an actuator cylinder connected to the movable supporting element 11 and to the operating frame 4 and able to allow the rotation of the latter around the axis of rotation A.

In particular, the rotation means 10 are adapted to rotate the insertion assembly 3 by an angle equal to the angle of insertion α.

Thanks to the presence of the counterweight element 2*b*, the machine 1 is able to translate and rotate the insertion assembly 3 until it reaches the insertion position, thus maintaining a high stability on the road surface R and in optimal safety conditions.

Advantageously, the machine 1 comprises an automatic control system adapted to command the operation of the machine itself comprising:

- at least one management and control unit of the automatic control system;
- remote control means of the machine 1; and
- at least one display to show the inclination of the insertion assembly 3.

The automatic control system allows the movement and operation of the machine 1 remotely, allowing the reinforcement operation of the safety barrier B to be carried out safely and quickly.

The remote control means are operationally connected to at least one of the movement assembly, the positioning means 9, 10 and the insertion assembly 3.

The display is conveniently made on the remote control means and allows monitoring the rotation of the insertion assembly 3 around the axis of rotation A so as to automatically check the correct inclination according to the angle of insertion α.

This way, the automatic control system is able to:

- move the machine 1 to the safety barrier B to be reinforced;
- operate the positioning means 9, 10 to position the insertion assembly between the home position, the operating position and the insertion position;
- check the correct inclination of the insertion assembly 3; and move and operate the insertion assembly 5 for the introduction of the reinforcement pole P into the ground.

The operation of the machine 1 according to the present invention is as follows. By means of the remote control means, the machine 1 is moved on the road surface R to be placed in the proximity of a sustaining pole S of a safety barrier B to be reinforced. (FIG. 1)

Figure 2:
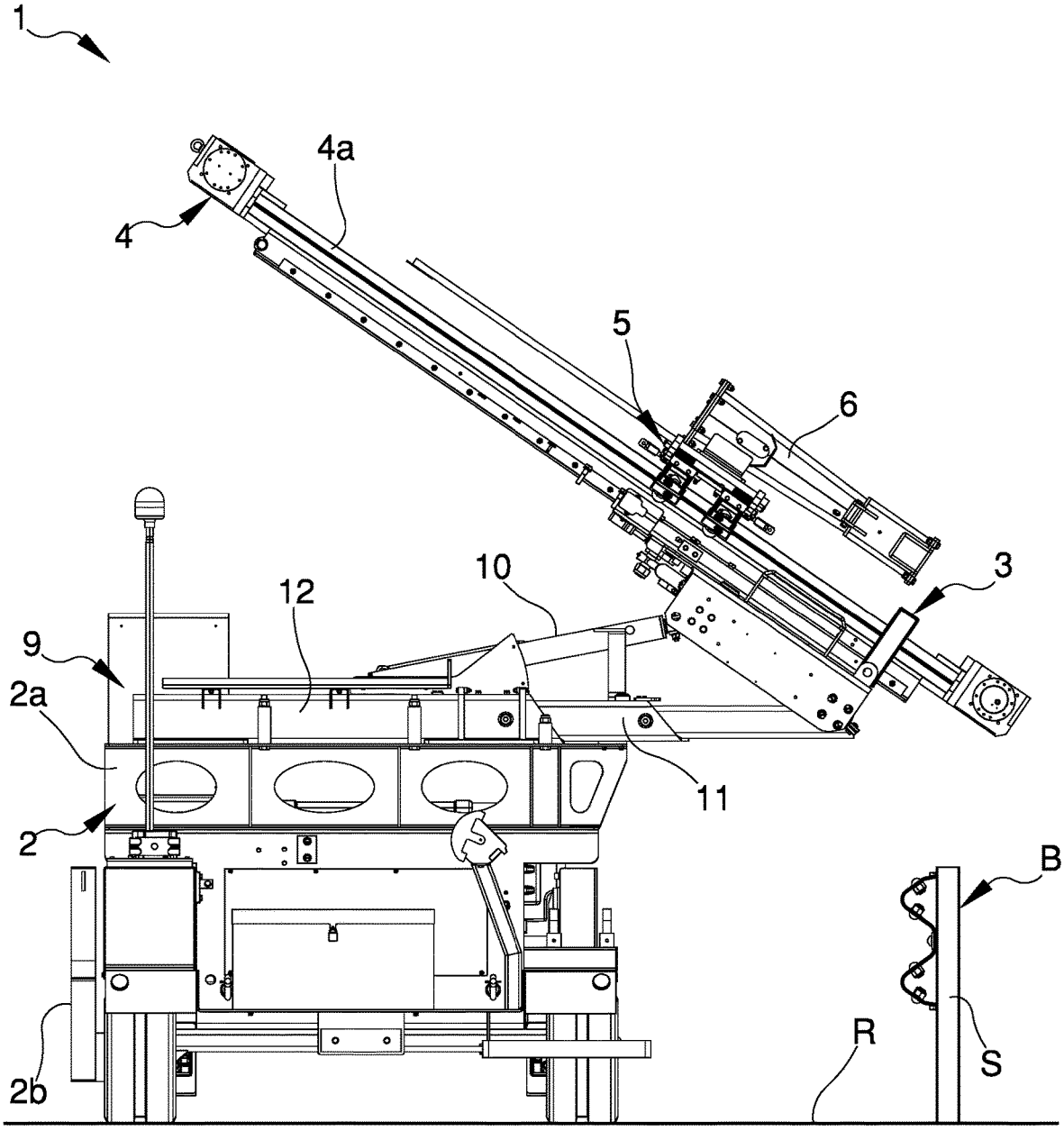
FIG. 2 is a rear view of the machine of FIG. 1.
Figure 3:
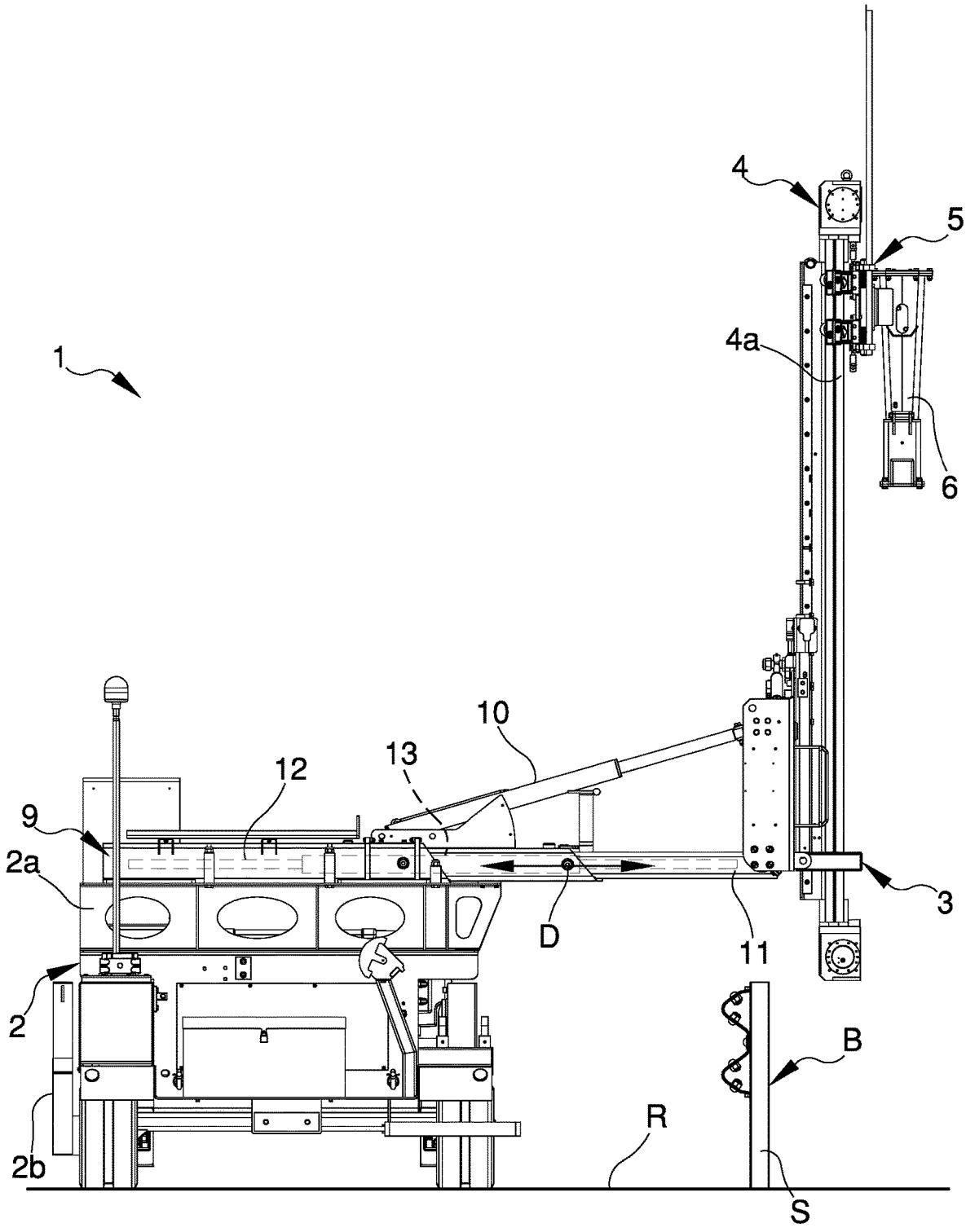
FIG. 3 is a rear view of the machine for the introduction of poles into the ground, in a second position of use, according to the invention.
Figure 4:
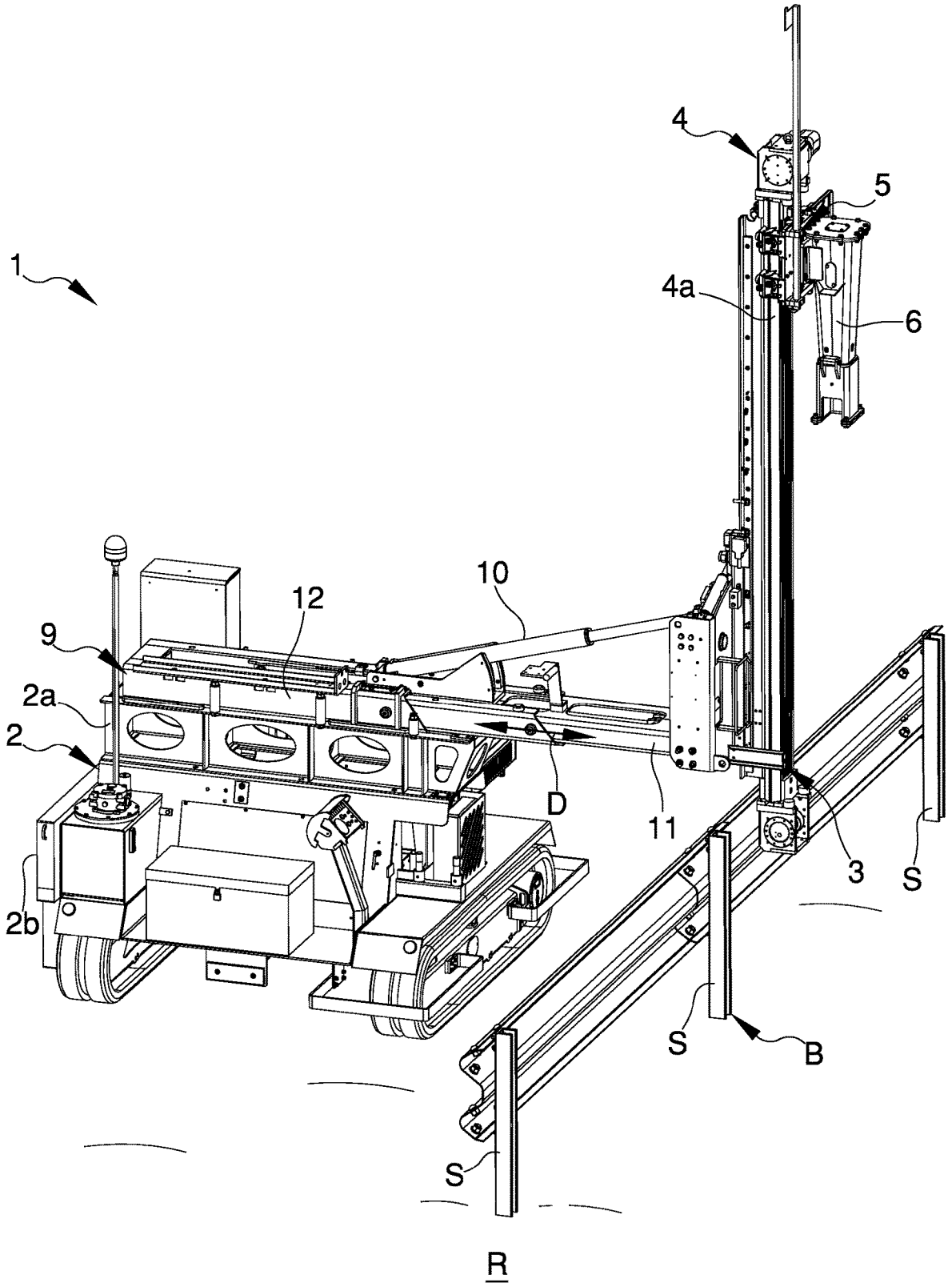
FIG. 4 is an axonometric view of the machine of FIG. 3.

The horizontal translation means 9 are then operated to position the insertion assembly 3 from the home position to the operating position, beyond the safety barrier B. (FIG. 2)

At this point, the insertion device 5 is moved to the away position and the reinforcement pole P is easily placed in the appropriate gripping means.

Figure 5:
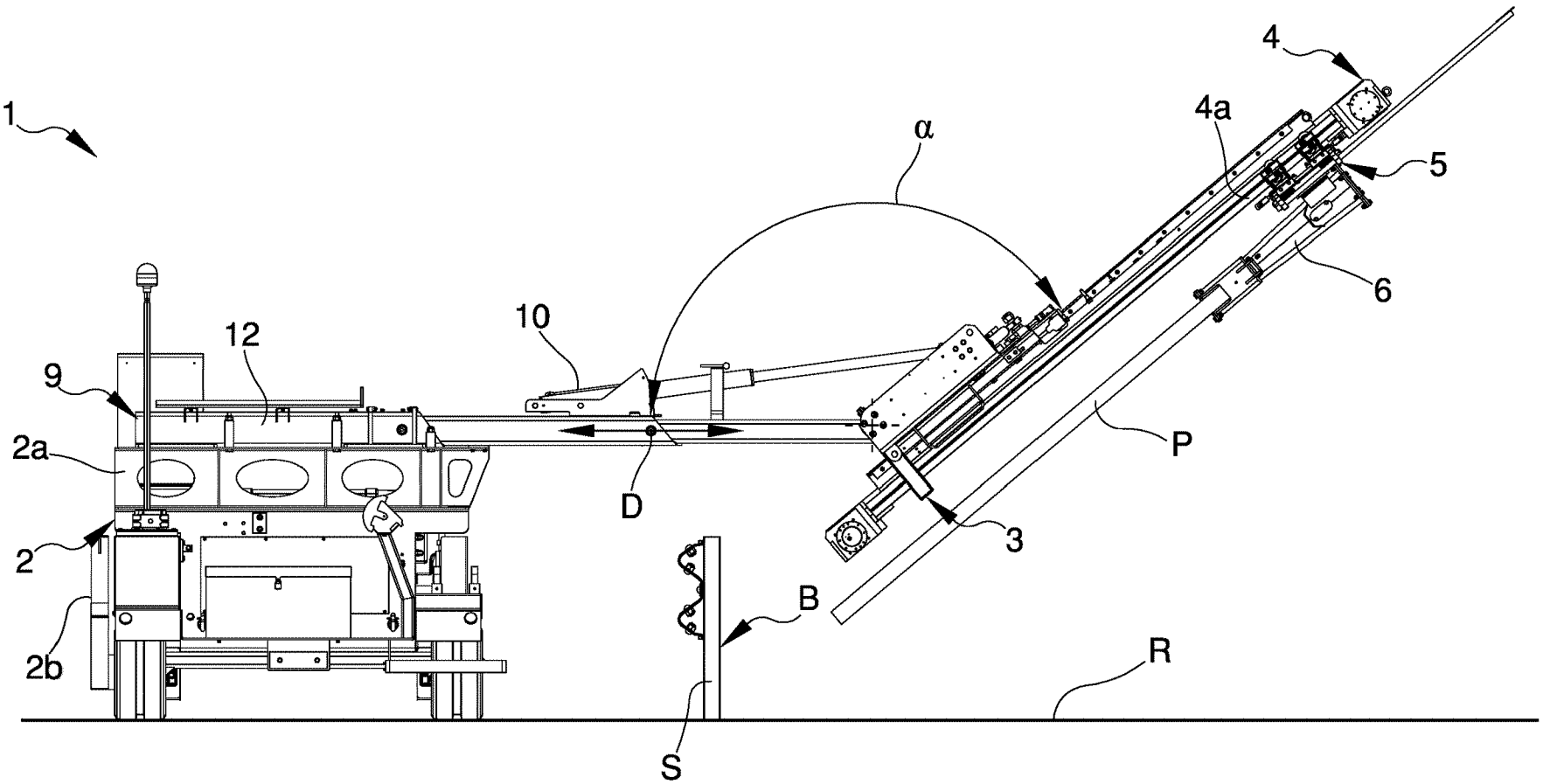
FIG. 5 is a rear view of the machine for the introduction of poles into the ground in a third position of use according to the invention.
Figure 6:
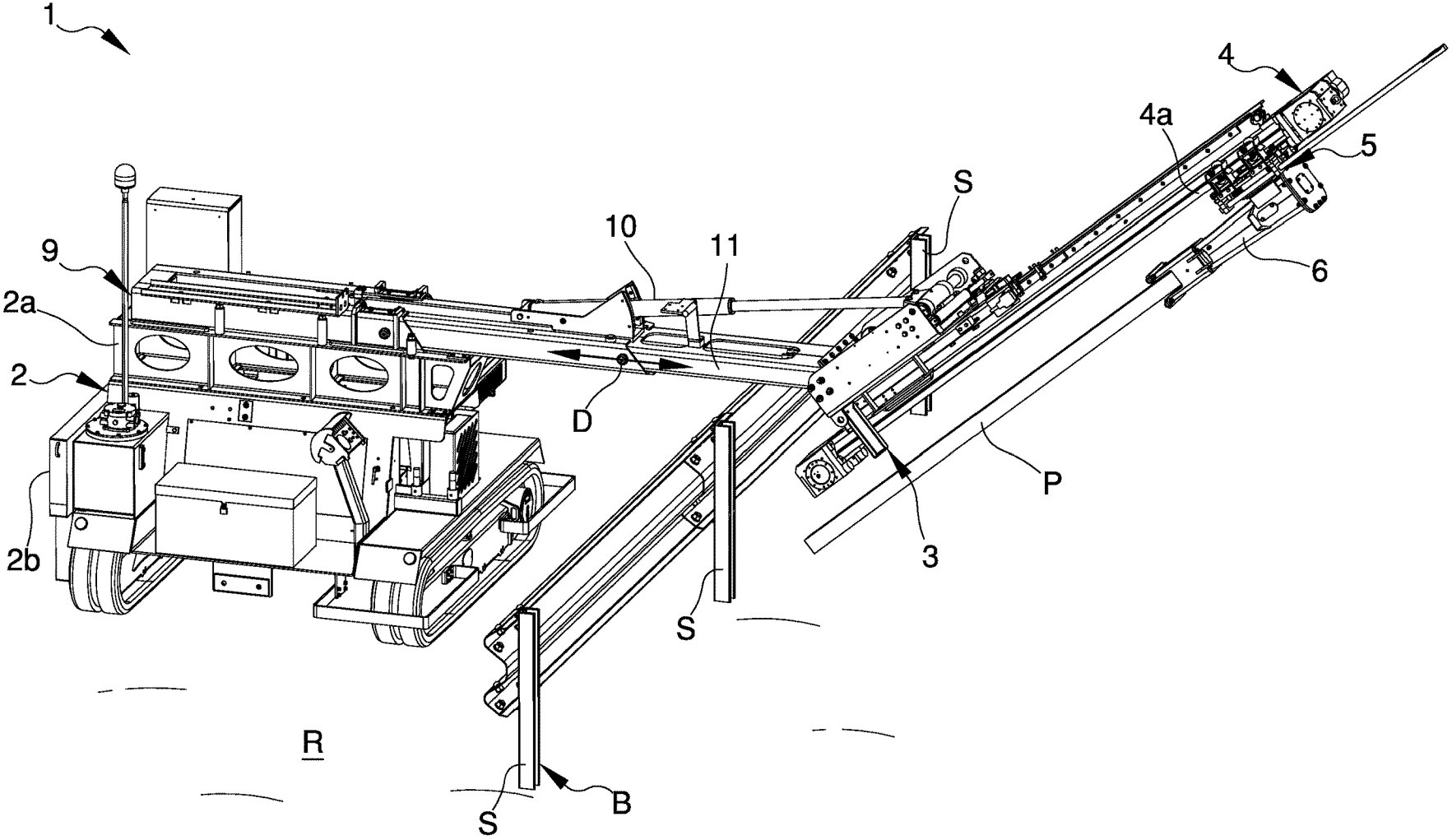
FIG. 6 is an axonometric view of the machine of FIG. 5.

The rotation means 10 are operated to move the insertion assembly 3 to the insertion position, inclined according to the angle of insertion α. (FIGS. 5-6)

Figure 7:
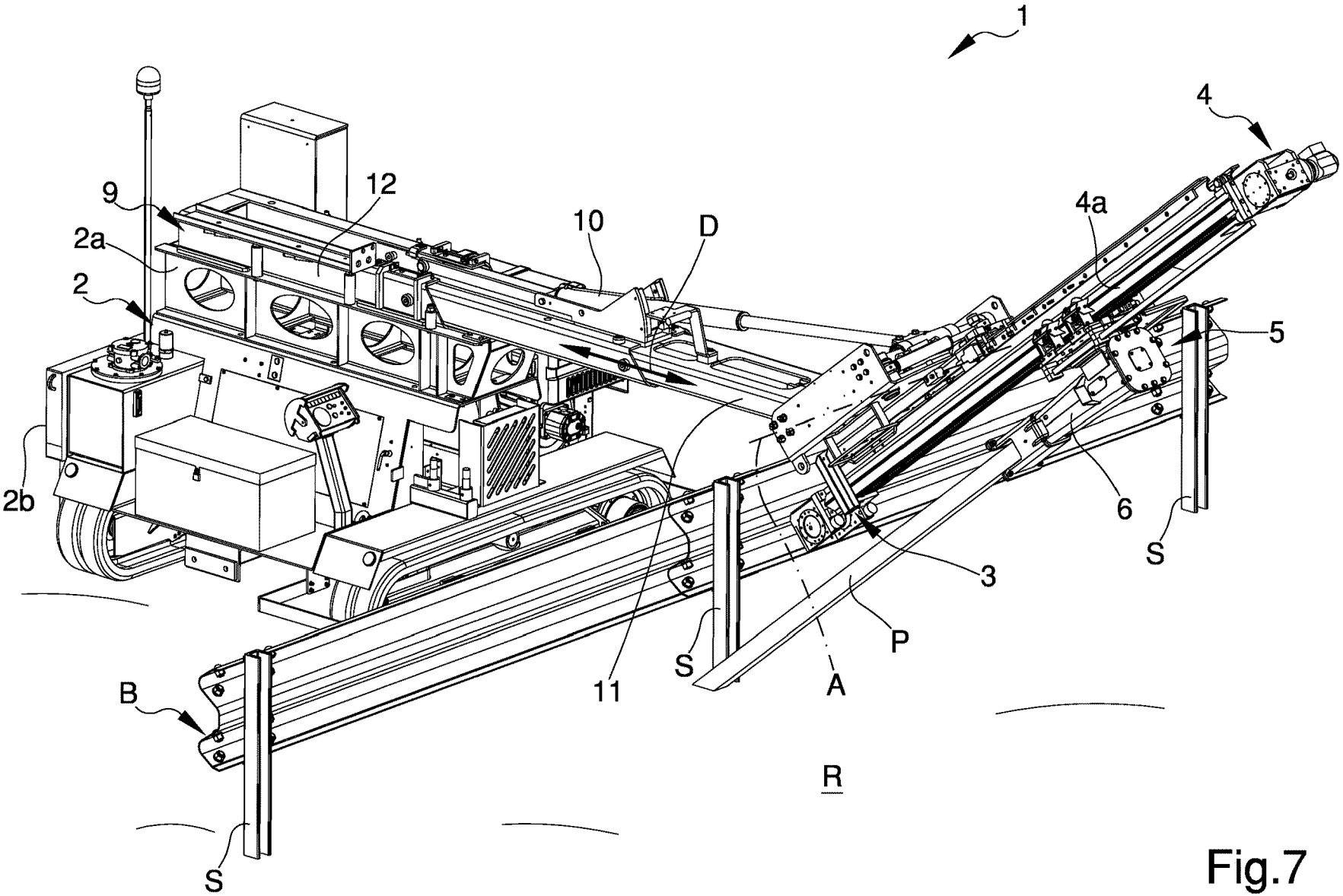
FIG. 7 is an axonometric view of the machine for the introduction of poles into the ground in a fourth position of use according to the invention.
Figure 8:
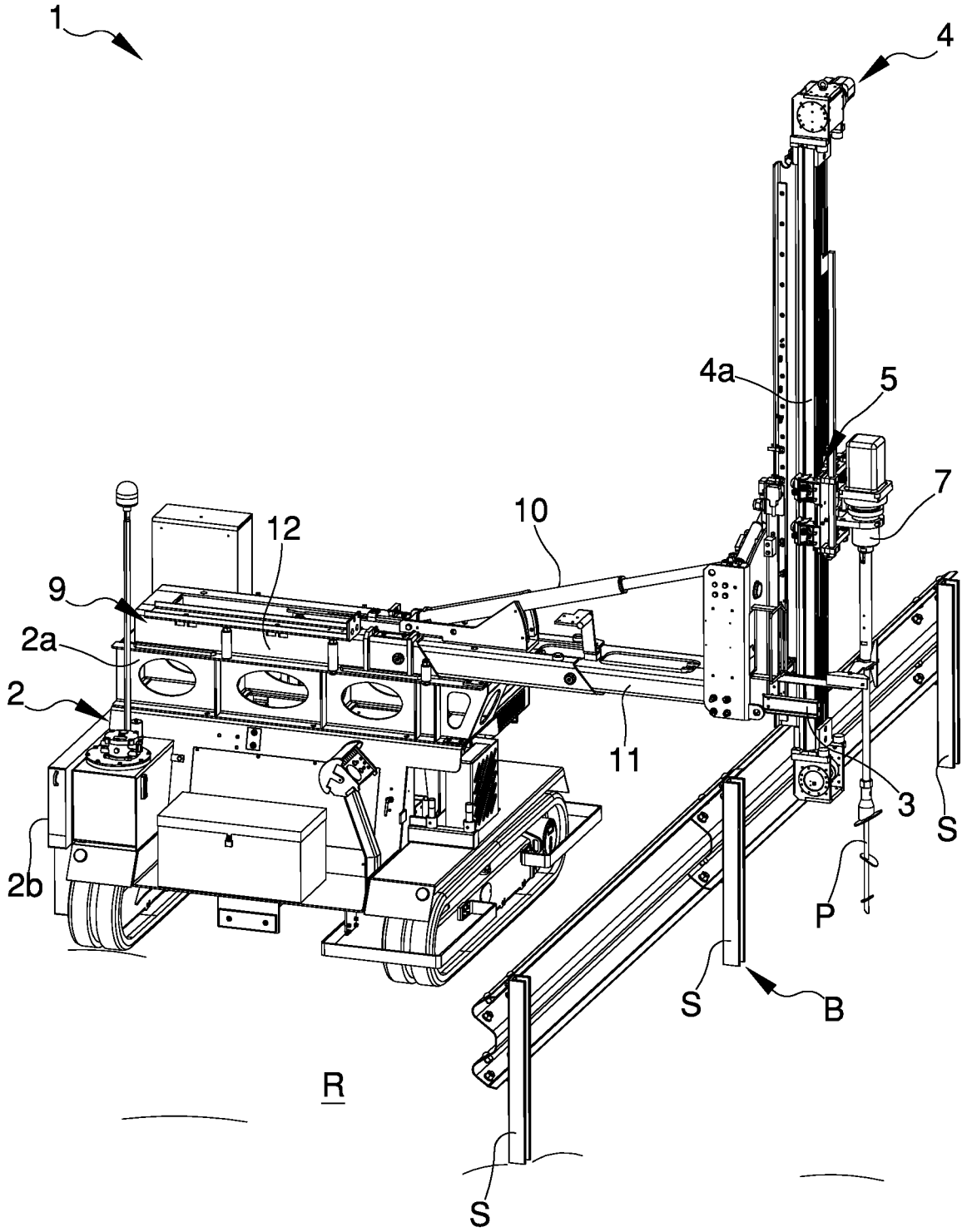
FIG. 8 is an axonometric view of a second embodiment of the machine for the introduction of poles into the ground according to the invention.

Then, the insertion device 5 is operated to drive and/or screw the reinforcement pole P into the ground, laterally to the sustaining pole S, and, at the same time, the sliding means move the insertion device itself towards the approach position, to facilitate the introduction of the reinforcement pole itself (FIG. 7)

Once the reinforcement pole P has been inserted, the sliding means move the insertion device 5 back to the away position and the rotation means 10 place the insertion assembly 3 to the operating position.

Finally, the reinforcement pole P is firmly attached to the sustaining pole S.

The operation cycle is, therefore, repeated with a plurality of reinforcement poles P until the reinforcement operation of the safety barrier B is completed.

It has in practice been ascertained that the described invention achieves the intended objects and in particular the fact is emphasized that the machine for the introduction of poles into the ground according to the invention allows carrying out the introduction of reinforcement poles for safety barriers quickly and safely, thus reducing the use of manpower.

The invention claimed is:

1. A machine for introducing poles into the ground for the reinforcement of safety barriers, wherein a safety barrier to be reinforced is composed of a series of sustaining poles inserted in the ground, laterally to a road surface and of a longitudinal band connecting the sustaining poles to each other and extending substantially parallel to said road surface R, said machine comprising:

- at least one movement assembly for movement of said machine on said road surface at the point where said safety barrier to be reinforced is located;
- at least one insertion assembly associated movable with said movement assembly and adapted to introduce at least partly into the ground at least one reinforcement pole at the point where the base of said safety barrier is located;
- positioning means associated with said movement assembly and adapted to position said insertion assembly between:
  - at least one home position, wherein said insertion assembly approaches said movement assembly to allow the transit of said machine;
  - at least one operating position, wherein said insertion assembly is located beyond and across said safety barrier; and
  - at least one insertion position, wherein said insertion assembly is tilted by an angle of insertion for the introduction of said reinforcement pole at the point where the base of said safety barrier is located, wherein
- said angle of insertion ranges from 130° to 150°;
- said movement assembly comprises a supporting frame, said supporting frame being configured to position said insertion assembly at a height equal to or higher than said safety barrier, and
- said positioning means comprise horizontal translation means to position said insertion assembly between said home position and said operating position, wherein in said operating and insertion positions the safety barrier is located between said movement assembly and said insertion assembly.

2. The machine according to claim 1, wherein, in said operating position, said insertion assembly is positioned substantially orthogonal to said road surface.

3. The machine according to claim 1, wherein that said insertion assembly comprises:

- at least one operating frame associated movable with said movement assembly;

at least one insertion device sliding associated with said operating frame;

sliding means of said insertion device on said operating frame adapted to displace said insertion device between a spacing apart position and at least one approach position, wherein the insertion device inserts said reinforcement pole at least partly into the ground.

4. The machine according to claim 3, wherein said insertion device comprises hammering means adapted to drive said reinforcement pole at least partly into the ground.

5. The machine according to claim 2, wherein said insertion device comprises screwing means adapted to rotate said reinforcement pole into the ground by screwing said reinforcement pole in the ground.

6. The machine according to claim 1, wherein said horizontal translation means comprise at least one movable supporting element of said insertion assembly associated translatable with at least one guide element mounted on said movement assembly.

7. The machine according to claim 6, wherein said movable supporting element is of the type of a telescopic boom.

8. The machine according to claim 1, wherein said horizontal translation means comprise at least one actuating element adapted to move said movable supporting element on said movement assembly, between said home position and said operating position.

9. The machine according to claim 6, wherein said positioning means comprise rotation means associated with said movable supporting element and adapted to rotate said insertion assembly around an axis of rotation substantially parallel to said road surface to position said insertion assembly in said insertion position.

10. An automatic control system adapted to command the operation of said machine of claim 1, said automatic control system comprising:

at least one management and control unit of said automatic control system;

remote control means of said machine; and at least one display programed to and/or configured to show the inclination of said insertion assembly.

11. The machine according to claim 10, wherein said remote control means are operationally connected to at least one of said movement assembly, said positioning means and said insertion assembly.

12. A machine for introducing poles into the ground for the reinforcement of safety barriers, wherein a safety barrier to be reinforced is composed of a series of sustaining poles inserted in the ground, laterally to a road surface and of a longitudinal band connecting the sustaining poles to each other and extending substantially parallel to said road surface R, said machine comprising:

at least one movement assembly for movement of said machine on said surface at a point where said safety barrier to be reinforced is located;

at least one insertion assembly associated movable with said movement assembly and adapted to introduce at least partly into the ground at least one reinforcement pole at a point where a base of said safety barrier is located;

a physical positioning device associated with said movement assembly and adapted to position said insertion assembly between:

at least one home position, wherein said insertion assembly approaches said movement assembly to allow transit of said machine;

at least one operating position, wherein said insertion assembly is located beyond and across said safety barrier; and at least one insertion position, wherein said insertion assembly is tilted by an angle of insertion for introduction of said reinforcement pole at the point where the base of said safety barrier is located, wherein said angle of insertion ranges from 130° to 150°;

said at least one movement assembly comprises a supporting frame, said supporting frame being configured to position said insertion assembly at a height equal to or higher than said at least one safety barrier, and said physical positioning device comprise a horizontal translation device to position said insertion assembly between a home position and an operating position, wherein in said operating and insertion positions the safety barrier is located between said movement assembly and said insertion assembly.

13. The machine according to claim 12, wherein that said insertion assembly comprises:

at least one operating frame associated movable with said movement assembly;

at least one insertion device sliding associated with said operating frame;

a physical sliding device of said insertion device on said operating frame adapted to displace said insertion device between a spacing apart position and at least one approach position, wherein the insertion device inserts said reinforcement pole at least partly into the ground.

14. The machine according to claim 13, wherein said insertion device comprises a physical hammering device adapted to drive said reinforcement pole at least partly into the ground.

15. The machine according to claim 13, wherein said insertion device comprises a physical screwing device adapted to rotate said reinforcement pole into the ground by screwing said reinforcement pole in the ground.

16. The machine according to claim 12, wherein said physical horizontal translation device comprise at least one movable supporting element of said insertion assembly associated translatable with at least one guide element mounted on said movement assembly.

17. The machine according to claim 16, wherein said physical positioning device comprise a physical rotation device associated with said movable supporting element and adapted to rotate said insertion assembly around an axis of rotation substantially parallel to said road surface to position said insertion assembly in said insertion position.

* * * * *